US009895603B2

(12) United States Patent
Weinshanker et al.

(10) Patent No.: US 9,895,603 B2
(45) Date of Patent: Feb. 20, 2018

(54) SYSTEM AND METHOD FOR DESIGNING AND SELLING GAMES

(71) Applicant: National Entertainment Collectibles Association, Inc., Hillside, NJ (US)

(72) Inventors: Joel Weinshanker, Hillside, NJ (US); Alexis N. Mueller, Apex, NC (US); Justin A. Ziran, Rutherford, NJ (US)

(73) Assignee: National Entertainment Collectibles Association, Inc., Hillside, NJ (US)

( * ) Notice: Subject to any disclaimer, the term of this patent is extended or adjusted under 35 U.S.C. 154(b) by 0 days.

(21) Appl. No.: 14/176,579

(22) Filed: Feb. 10, 2014

(65) Prior Publication Data

US 2014/0228099 A1 Aug. 14, 2014

Related U.S. Application Data

(60) Provisional application No. 61/762,476, filed on Feb. 8, 2013.

(51) Int. Cl.

| | |
|---|---|
| ***A63F 9/00*** | (2006.01) |
| ***A63F 9/04*** | (2006.01) |
| ***A63F 3/00*** | (2006.01) |
| ***A63F 1/00*** | (2006.01) |
| ***G07F 17/32*** | (2006.01) |
| *A63F 1/02* | (2006.01) |
| *A63F 9/24* | (2006.01) |

(52) U.S. Cl.

CPC ..... *A63F 9/04* (2013.01); *A63F 1/00* (2013.01); *A63F 3/00* (2013.01); *G07F 17/3227* (2013.01); *G07F 17/3293* (2013.01); *A63F 2001/022* (2013.01); *A63F 2003/00892* (2013.01); *A63F 2009/0497* (2013.01); *A63F 2009/2455* (2013.01)

(58) Field of Classification Search

None

See application file for complete search history.

(56) References Cited

U.S. PATENT DOCUMENTS

| | | | | |
|---|---|---|---|---|
| 2004/0209691 | A1* | 10/2004 | Roush | A63F 13/12 463/40 |
| 2005/0266906 | A1* | 12/2005 | Stevens | G07F 17/323 463/1 |
| 2007/0077978 | A1* | 4/2007 | Walker | G07F 17/32 463/16 |
| 2009/0327723 | A1* | 12/2009 | Yates | G06Q 10/06 713/168 |
| 2011/0256933 | A1* | 10/2011 | Place | A63F 13/12 463/42 |

(Continued)

*Primary Examiner* — Seng H Lim

(74) *Attorney, Agent, or Firm* — McCarter & English, LLP

(57) ABSTRACT

Systems and methods for designing and selling a user-generated game offered for sale via an online retail platform are provided. A user can input user-specified game information via a computing device over a network instructions for the development of the components of a game are automatically created based at least in part on the user-specified game information. Moreover, the systems and methods may further include transmitting the instructions for the development of the components of the game to an online retail platform, print on demand manufacturing the game, and thereafter offering the game for sale or rent via the online retail platform.

20 Claims, 5 Drawing Sheets

(56) References Cited

U.S. PATENT DOCUMENTS

| | | | | |
|---|---|---|---|---|
| 2012/0244950 | A1* | 9/2012 | Braun | A63F 13/10 463/42 |
| 2013/0031643 | A1* | 1/2013 | Rogel | G06F 21/10 726/29 |
| 2014/0094312 | A1* | 4/2014 | Wouhaybi | A63F 3/00643 463/42 |
| 2014/0162776 | A1* | 6/2014 | Lucas | A63F 13/10 463/31 |

* cited by examiner

SYSTEM AND METHOD FOR DESIGNING AND SELLING GAMES

CROSS-REFERENCE TO RELATED APPLICATION

This application claims priority to U.S. Provisional Patent Application No. 61/762,476 filed on Feb. 8, 2013, which is incorporated herein in its entirety by reference and made a part hereof.

BACKGROUND

Field

The present disclosure relates generally to a system and method for designing games and offering same for sale.

Related Art

Designing games, such as board games, is challenging because of a lack of tools available for use by a game designer. Even if a good game is developed, marketing and selling the game presents another challenge. Game designers typically have very limited access to the market and essentially are forced to go through a very small number of industry gatekeepers that often extract an unreasonable amount of compensation from the designer for such access.

Thus, despite efforts to date, a need remains for improved systems and methods for creating or designing user-generated games, and for marketing and distributing such games. These and other inefficiencies and opportunities for improvement are addressed and/or overcome by the systems and methods of the present disclosure.

SUMMARY

A system and method for designing and selling games is provided. The method includes accessing game development software via a first computing device or processor, inputting user-specified game information, and automatically generating instructions for making the components of the game based at least in part on the user-specified game information. In certain embodiments, the method may further include the steps of transmitting the instructions for making the components of the game to an online retail platform, where the game is offered for sale or rent. Manufacturing of games can be done as needed by printing on demand at the retail platform or elsewhere.

Any combination or permutation of embodiments is envisioned. Additional advantageous features, functions and applications of the disclosed systems and methods of the present disclosure will be apparent from the description which follows, particularly when read in conjunction with the appended figures.

BRIEF DESCRIPTION OF THE DRAWINGS

The foregoing features will be apparent from the following Detailed Description, taken in connection with the accompanying drawings, in which.

Figure 1:
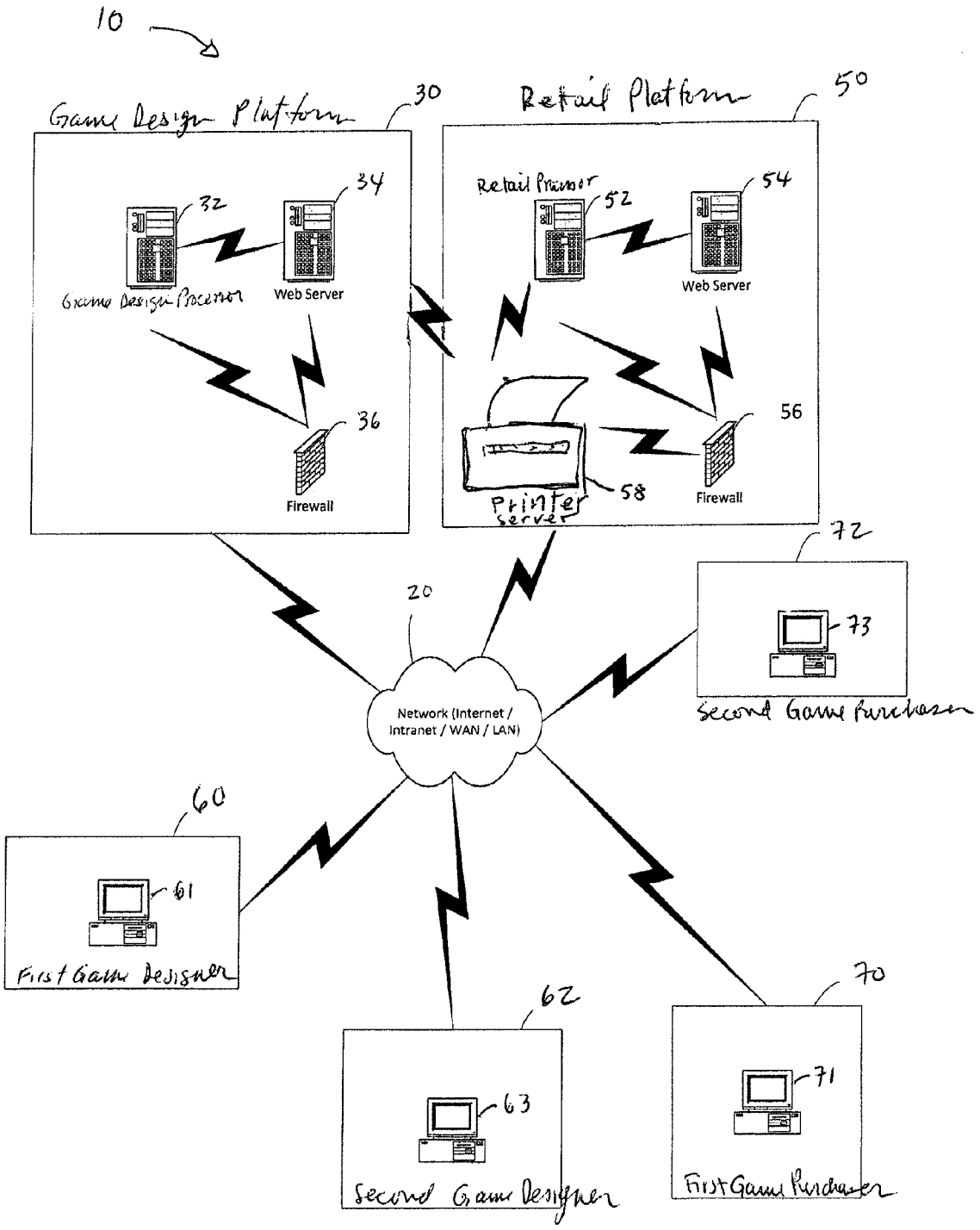
FIG. 1 is a diagram of the system of the present disclosure for designing, manufacturing and selling a game.

It is to be noted that the various steps/features and combinations of steps/features described below and illustrated in the figures can be arranged and organized differently to result in embodiments which are still within the spirit and scope of the present disclosure.

DETAILED DESCRIPTION

The present disclosure relates to a system and method for designing and selling user-generated games. More particularly, the present disclosure provides systems and methods for allowing game designers to access a game design platform over a computer network to design a game, and then access a retail platform over a computer network for making and selling the game.

In exemplary embodiments, the present disclosure provides systems/methods for creating a user-generated game including allowing a user to input user-specified game information into a game design processor, and to automatically generate instructions for the development of the components of a game based at least in part on the inputted user-specified game information. Moreover, the systems/methods may further include transmitting the instructions for the development of components of the game to an online retail platform (e.g., via the processor), and thereafter offering the game for sale or rent via the online retail platform to third-party purchasers. In certain embodiments, the online retail platform includes a print on demand online retail platform.

The systems/methods of the present disclosure will allow game designers or the like to make and widely distribute their games quickly and in a far more profitable manner. Moreover, the ease of release and the financial benefit from the systems/methods of the present disclosure will result in designers foregoing the traditional model in favor of the systems/methods of the present disclosure. As such, the systems/methods of the present disclosure will allow many games to enter the market and succeed.

Exemplary embodiments of the present disclosure are directed to a system in an electronic commerce environment that can be programmed and/or include executable code configured to receive user-specified game information from a user for a game (e.g., a table top game such as a board game, card game, dice game or the like) to be developed, and generate instructions for the development of the components of the game based at least in part on the user-specified game information. In general, the instructions for the development of the components of the game may be transmitted to an online retail platform (e.g., website), and the game may thereafter be offered for sale via the online retail platform.

Referring now to the drawings, like parts are marked throughout the specification and drawings with the same reference numerals, respectively. Drawing figures are not necessarily to scale and in certain views, parts may have been exaggerated for purposes of clarity.

FIG. 1 is a diagram of an exemplary game design and selling system 10. The system 10 includes a game design platform 30 comprising one or more computing systems including a game design processor 32, a web server 34 and a firewall 36. The game design platform 30 can be accessed by users over a network 20 such as the Internet or other network, such as an Internet or a wide area network (WAN) or a (LAN) to create/design a user-generated game.

System 10 may include a retail platform 50 for allowing users to purchase games. The retail platform 50 can be accessed by users over network 20. Retail platform 50 can also be in direct communication with game design platform 30. Retail platform 50 could also be a part of the game design platform 30. Retail platform 50 may include a retail processor 52, a web server 54, a firewall 56 and a printer server 58 which may include a print on demand device.

The system 10 of the present disclosure can be accessed by users over network 20. Various types of uses can access the system 10 including, but not limited to, game designers, game purchasers and others. For example, first game designer 60 can access the system 10 with a first computer system 61 using a first communications link over network 20 with game design platform 30 or retail platform 50 for communications concerning game designs and/or sales. A second game designer 62 can access the system 10 with a second computer system 63 using a second communications link over network 20 with game design platform 30 or retail platform 50 for communications concerning game designs and/or sales.

A first game buyer 70 could access the system over network 20 with a third computer system 71 using a third communications link with retail platform 50 for communications concerning purchasing games. Similarly, a second game buyer 72 could access the system over network 20 with a fourth computer system 73 using a fourth communications link with the retail platform for communications concerning purchasing games. Such communication could encompass the sending and receiving of data, instructions and/or funds from party to party. It is to be noted that system 20 may include any number of communications links and that any number of game designers 60, 62 and any number of game buyers 70, 72 could communicate with the game design and retail platforms 30, 50 over any number of communications links.

The game design processor 32 and the retail processor 52 can include single or multiple processors (or a single processor having multiple processor cores), and can include any suitable operating system and associated system software, such as the UNIX operating system, Linux, Microsoft Windows, etc. Furthermore, the functions performed by processors 32 and 52 could be provided by a single computer system, or by multiple networked computer systems (e.g., cloud or grid computing). Similarly, web servers 34 and 54 could be provided by a single computer system, or by multiple networked computer systems (e.g., cloud or grid computing). The processors 32 and 52, and servers 34 and 54 can be located on third-party computer systems or the like. It is understood that the system/method steps associated with the present disclosure could be performed, at least in part, via computer-executable instructions stored on computer-readable media. Game design processor 32 and retail processor 52, in combination with other components of the invention, could provide much of the functionality and processing described throughout the specification. Web servers 34 and 54 can host a game design web site and an online retail store respectively.

The computer systems 61, 63, 71 and 73 could each be any suitable computer system having the ability to communicate via a network 70 (e.g., having Internet connectivity), which could include a personal computer, a laptop computer, a tablet computer, a smartphone, etc. The game design platform 30 and retail platform 50 and be accessed by computer systems 61, 63, 71 and 73 using a web browser or through an application software program (app).

Figure 2:
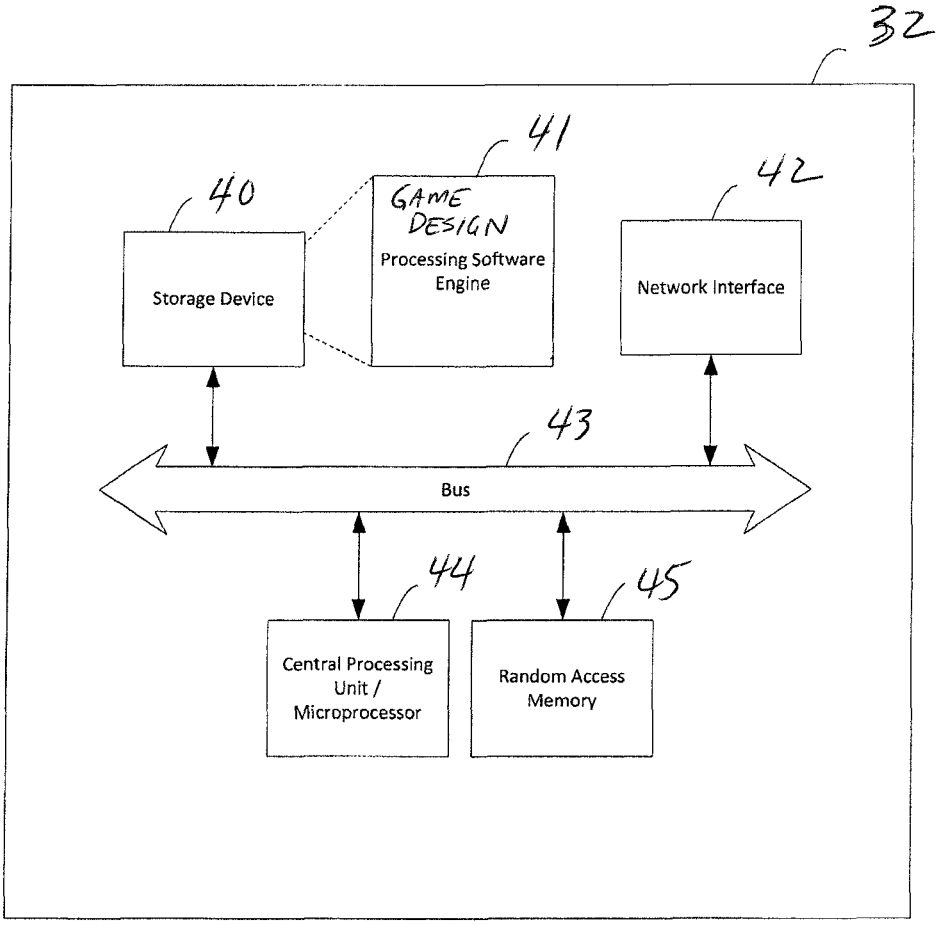
FIG. 2 is a diagram showing sample components of the processing server shown in FIG. 1.

FIG. 2 is a diagram showing components of the game design processor 32 in greater detail. Processor 32 could include a storage device 40 which could include any suitable computer-readable storage medium such as disk, non-volatile memory (e.g., EPROM, EEPROM, a flash memory, etc.), as well as a network interface 42, a communications bus 43, a central processing unit (e.g., incorporating a single or multiple-core microprocessor) 44, a random access memory (RAM) 45, etc. Much of the functionality provided by the present disclosure could be provided by a game design processing software engine 41, which could be embodied as computer-readable program code stored on the storage device 40 and executed by the CPU 44 using any suitable, high or low level computing language, such as Java, C, C++, C#, .NET, etc. The network interface 42 could include an Ethernet network interface device, a wireless network interface device, or any other suitable device which permits the processing server/computing device 60 of system 20 to communicate via a network. It is to be noted that computer systems 52, 61, 63, 71 and 73 each could include some or all of the elements shown in FIG. 2.

In general, the functionality of game design processor 32 and retail processor 52 can be implemented using hardware, software and/or a combination thereof. In general, the processors 32 and 52 can be configured and adapted for use on various different computing/processing platforms and/or operating systems. Each computing device 32, 52 typically is in communication with a network/internet/cloud computing environment. It is noted that processing instructions can be stored in a non-transitory computer-readable medium and can include instructions or code that can be executed by processors 32 and 52 to design/sell a game.

Figure 3:
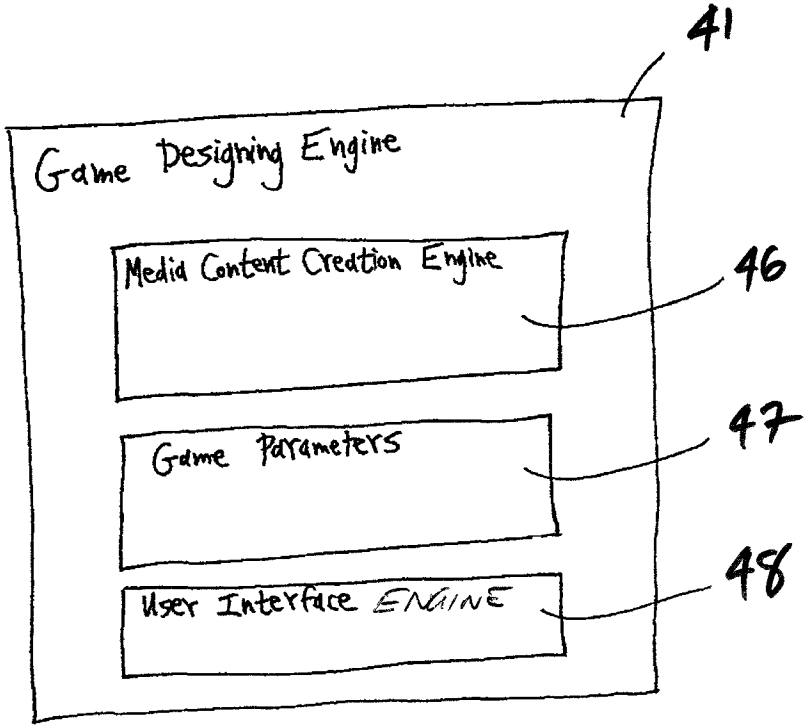
FIG. 3 is a diagram of an exemplary game designing engine in accordance with the present disclosure.

In exemplary embodiments and as shown in FIG. 3, the game design engine 41 could include a user interface engine 48, game parameters 47 (e.g., user-specified game information/parameters), and a media content creation engine 46. In general, engine 41 can be programmed and/or include executable code configured to receive user-specified game information from a user (e.g., a user of system 10) for a game (e.g., board game and/or card game) to be developed via user interface screens 48 generated by the engine 31, and generate instructions (via engine 41) for the development of the components of the game based at least in part on the user-specified game information. The instructions for the development of the components of the game may then be transmitted, via engine 41 and/or network 20, to online retail platform 50.

In exemplary embodiments, the user interface engine 48 can be programmed and/or include executable code to generate a graphical user interface or the like through which a user can interact with engine 41. In one embodiment, the user interface can be associated with one or more web pages of a merchant website (e.g., platform 50), and the graphical user interface can be displayed to the user. The user interface displayed to the user can include data entry area to receive information from the user and/or can include data outputs to display information to the user. For example and as discussed further below, the user interface can be programmed and/or include executable code to receive user-specified game information 47 from the user for the development/design/creation of a game (e.g., board game and/or card game). In general, the user interface can be programmed and/or include executable code to interface with the media content creation engine 46 for the development of a game using engine 41.

The game parameters 47 correspond to parameters/information specified by the user. In general, the game parameters 47 can include the number and/or type of components to be utilized in a user-created game. For example, some game parameters 47 to be specified by a user include whether the game is to include dice, cards and/or tokens or the like. In general, a user may specify a number of suitable options for the game components (e.g., dice, tokens and/or cards).

If the user specifies that the game is to include dice, the user may further be prompted (e.g., via the user interface) to specify/decide what type of dice to include (e.g., 4-sided, 6-sided, 8-sided, 10-sided, 12-sided, 20-sided, percentile sided) and/or what color of dice to include (e.g., red, green, blue, yellow, brown, purple, white, black, etc.). Moreover, the user may also specify what type/shape/color of dice pouch, if any, to include with the game. These choices could be menu driven or the like.

Another game parameter could be specified by a user as to whether the game includes tokens/figures or the like. If the user specifies that the game is to include tokens, the user may further be prompted (e.g., via the user interface) to specify/decide what type of tokens to include (e.g., cardboard-based, plastic-based, wood-based, metal-based), and/or what color of tokens to include (e.g., red, green, blue, yellow, brown, purple, white, black, etc.), and/or what shape/type/number of tokens to include (e.g., flat, square, round, hex, cube, pyramid, pawn, meeple, etc.).

Also as noted, another game parameter could indicate whether the game includes cards or the like. If the user specifies that the game is to include cards, the user may further be prompted (e.g., via user interface) to specify/decide what size (e.g., small, medium, large, rectangular, etc.) and/or type of cards to include (e.g., hero, creature, terrain, object, ability, event, location, state, trigger condition, number, solid color, color, etc.). Moreover, the user could also specify whether the cards are basic text only cards (e.g., with colored border art and/or two empty spaces for art and/or text). In one embodiment, the user-specified cards could have one or more (e.g., four) circles, squares and/or triangles in the corners of the cards for point values or the like. The cards could also account for orientation. In exemplary embodiments, the user-specified cards would be set-up for delivery to a print on demand platform 58 (e.g., a print on demand online retail platform) for subsequent delivery to a purchaser (e.g., a purchaser via game buyer computer system 70 and/or 72). It is to be noted that users/designers may also purchase games from platform 50. Similarly, users/purchasers (e.g., users of systems 60, 62) may also design/create games via game design platform 30 for subsequent purchase from platform 50.

In exemplary embodiments, engine 41 can be programmed and/or include executable code to specify some of the game parameters 47 and/or to restrict the user's entries to choices specified by the engine 41. For example, the engine 41 can be programmed to specify what types/shapes/colors/prices of components (e.g., dice, tokens and/or cards) are available for selection/specification, as well as specify other parameters. The engine 41 can be programmed and/or include executable code to store the user-specified game parameters 47 for use by the media content creation engine 46. For example, once the user has entered the requested data in the data entry fields of the user interface, the user can click on a submit button or the like to initiate the design/creation of the instructions of the game by the media content creation engine 46.

The media content creation engine 46 can be programmed and/or include executable code to use rules/analytics based on the stored game parameters 47 received from the user. The rules/analytics can be used by engine 46 to develop/generate instructions for the development of the components of the game based at least in part on the stored user-specified game parameters 47. For example, the instructions for the development of the components of the game may include whether the game includes dice, tokens and/or cards, and what specific types of user-specified dice, tokens and/or cards to include with the game (including any print on demand instructions for the cards, etc.).

In exemplary embodiments, the engine 46 can be programmed to determine the minimum and/or user-selected price for each user-specified game component/parameter, as well as specify/determine other parameters. It is to be noted that in exemplary embodiments, a user may set a price above the minimum specified/determined price for each component/parameter (e.g., via user interface). As such, engine 46 can be used to determine the overall price of a user-specified game that is to be offered for sale to purchasers.

After the media content creation engine 46 has designed/created/generated the instructions of the game specified by the user, the instructions may then be transmitted via engine 41 to an online retail platform 50 in communication with network/Internet 20. The user-specified game, including the instructions for the development of the components of the game, may then be available for purchase or rental by a third-party purchaser via the online retail platform 50. Once a third-party purchaser has placed an order for the user-specified game, the online retail platform 50 may then ship the ordered components and the like to the purchaser, and/or send the instructions for the development of the components of the game to a print on demand platform 58 for subsequent delivery to the purchaser once printing/creation is completed by the print on demand platform 58.

Figure 4:
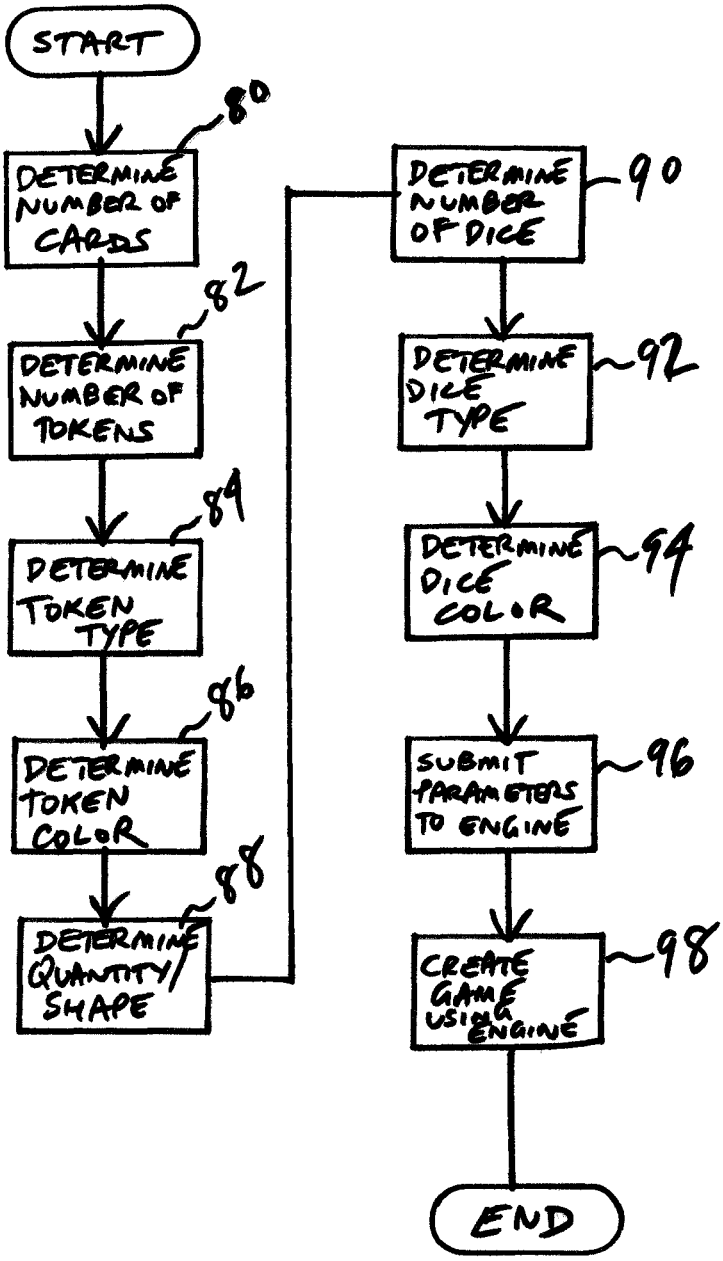
FIG. 4 is an exemplary flowchart of a method for designing a game according to the present disclosure.

FIG. 4 is an exemplary flowchart of a method for designing a game according to the present disclosure. In exemplary embodiments, a user of engine 41 may first be directed by user interface to specify if cards are to be included in the game currently being designed by the user, and to specify the number of cards (Step 80). If the user specifies that no cards are to be included, the user may then be directed by the user interface to specify if tokens are to be included (Step 82). If the user specifies that tokens are to be included, the user may then be directed to specify what types of tokens (e.g., cardboard-based, plastic-based, wood-based, metal-based) are to be included (Step 84), and what color of tokens (e.g., red, green, blue, yellow, brown, purple, white, black, etc.) are to be included (Step 86), and what shape/type/number of tokens (e.g., flat, square, round, hex, cube, pyramid, pawn, meeple, etc.) are to be included (Step 88).

After the user specifies the tokens, the user may then be directed to specify if dice are to be included (Step 90). If the user specifies that dice are to be included, the user may then be directed to specify what types of dice (e.g., 4-sided, 6-sided, 8-sided, 10-sided, 12-sided, 20-sided, percentile sided) are to be included (Step 92), and what color/number of dice (e.g., red, green, blue, yellow, brown, purple, white, black, etc.) are to be included (Step 94) in the designed game.

In an exemplary embodiment and as shown in FIG. 4, the user has selected: (i) no cards for the user designed game; (ii) eight blue-colored, plastic-based pawn tokens and eight red-colored, plastic-based pawn tokens for the user designed game; and (iii) two white/black six-sided dice for the user designed game. The user can then click on a submit button in step 96 to initiate the design/creation of the instructions of the game by the media content creation engine 46. Thereafter, in step 98, the engine creates the game.

In exemplary embodiments, the media content creation engine 46 and/or engine 41 includes application (App) software, such as application development software. In certain embodiments, engine 46 includes media development software or the like. In general, development software is configured and adapted to generate print and/or electronic media.

Figure 5:
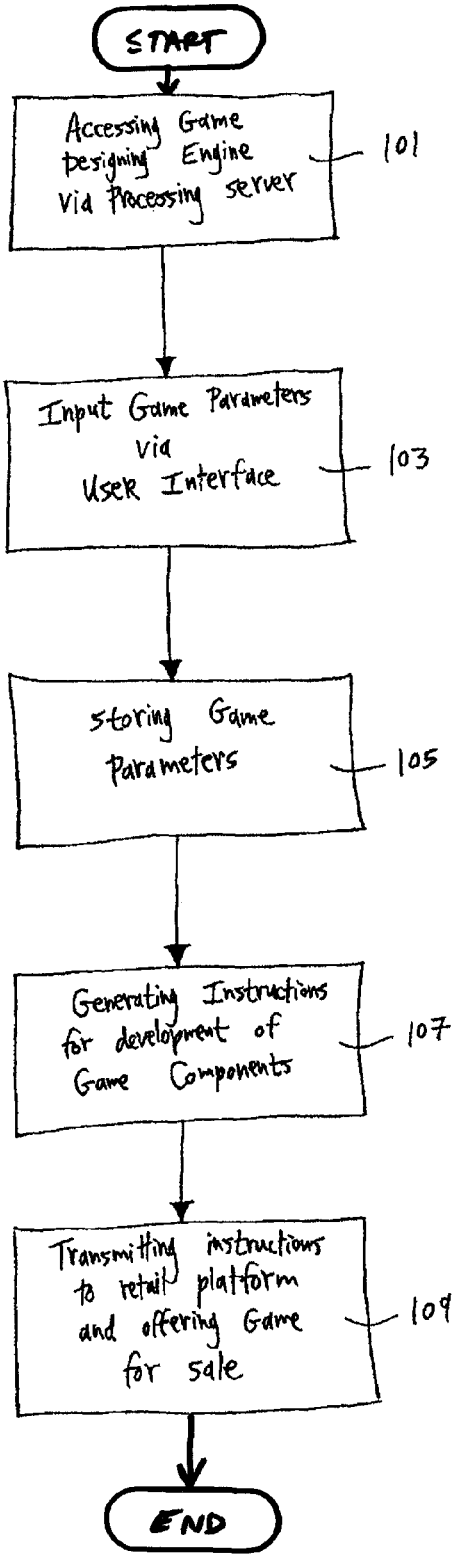
FIG. 5 is a flowchart of an exemplary method for creating a user-generated game according to the present disclosure.

FIG. 5 depicts a flowchart of an exemplary method for creating a user-generated game according to embodiments of the present disclosure. As shown in FIG. 5, step 101 includes accessing the engine 41 via processing server 32 (which could be accessed using any of the devices 61, 63, 71, or 73 shown in FIG. 1). In step 103, the user inputs the game parameters into engine 41 via a user interface. Step 105 includes the step of storing the game parameters. The instructions for the development of the game components are generated via engine 46 in step 107. Step 109 includes transmitting the generated instructions via engine 41 to platform 50, and thereafter offering the user-designed game for sale/rental via platform 50.

In exemplary embodiments, users of engine 41 may sign-up for a membership (e.g., an annual membership) for use of system (e.g., via a user interface). In certain embodiments, the game or games created/designed by the users are to be owned by the users/creators, and sold (e.g., exclusively) via the platform 50. In one embodiment, after a user signs up for a membership to use engine 41, the user would then sign a license agreement or the like that would cover various issues (e.g., conditions of use of engine 41, intellectual property ownership, representations of non-infringement, indemnifications, take-down guidelines, financial terms (noted below), etc.).

In exemplary embodiments, proceeds from the sales of the user-designed games may be split (e.g., 70%/30%) between the user and the platform 50. Moreover, other financial provisions/terms may be entered, such as various options the platform 50 may have if certain sales thresholds are met by sales of the user-designed game. Games could be sold to customers on a per game basis, or a customer could subscribe and periodically receive games over a period of time.

A game design kit may include standardized components (including but not limited to dice; cards; cardboard, plastic, and wood tokens, etc.) which could be of various colors (e.g. red, green, blue, yellow, brown, purple, white, and black). Users could sign up for an annual membership to use the kit to design tabletop games (board games, card games, dice games, etc.) to be owned by the designer and sold (e.g., exclusively) on a print on demand online retail platform (a store). Upon sign up, the game designer could sign a license agreement that covers the conditions of their use of the kit and the store including, but not limited to, IP ownership, representations of non-infringement, indemnifications, take-down guidelines, etc., as well as certain financial terms noted below.

The kit could automatically set a minimum price for each game on the store based on the components comprising the game. The game designers can set a price above that minimum. Proceeds from the sales could be split 70/30 (developer/system). If a game sells more than a threshold ($[x.xx] in one year, or $[y.yy] total sales), the system could have the option to either: (1) publish the game and, instead of the 70/30 split, pay the designer a royalty (could be some amount greater than the percentage normal designers get like 10%) of the sales of the game; or (2) the system could pay the designer some multiple of the sales threshold to buy the rights to the game, with no further payment obligations to the designer, and it could be provided that system continued to provide a "Create by" or "Designed by" credit on subsequent releases.

The kit could include the following standardized components made of basic colors (red, green, blue, yellow, brown, purple, white, and black):

- Dice (4-sided, 6-sided, 8-sided, 10-sided, 12-sided, 20-sided, percentile-sided). We could offer dice pouches in the same colors
- Cards (two sizes: small and large rectangular. Types: hero, creature, terrain, object, ability, event, location, state, trigger condition, number, and solid color). The cards could be basic text only cards with colored border art and two empty spaces (for art and/or text). The cards could have up to four circles/squares/triangles in the corners for point values. The cards could account for orientation. The cards would likely be digital print on demand.
- Flat cardboard/plastic/wood/metal tokens: square, round, hex
- Other plastic/wood/metal tokens: cube, pyramid, pawn, "meeple"

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

The exemplary embodiments disclosed herein are illustrative of a system and method for designing games and offering games for sale. It should be understood, however, that the disclosed embodiments are merely exemplary of the present disclosure, which may be embodied in various forms. Therefore, details disclosed herein with reference to exemplary embodiments and associated methods/techniques of use are not to be interpreted as limiting, but merely as the basis for teaching one skilled in the art how to make and use the systems/methods of the present disclosure.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

Having thus described the invention in detail, it is to be understood that the foregoing description is not intended to limit the spirit or scope thereof. What is desired to be protected is set forth in the following claims.

What is claimed is:

1. A method for creating a user-generated board game comprising:

providing a first game design platform on a computer network with a first computing device;

providing a game design kit separate from the game design platform, the game design kit having at least one standardized component for designing a tabletop game;

receiving, at the first computing device, over the computer network by a communication link, user-specified game information through a graphical user interface, the user-specified game information including number and type of components for a game and game rules;

generating instructions at a second game development platform for development of the components of the game based on the user-specified game information and a set of rules or analytics;

transmitting the instructions to a third retail platform in communication with the game design platform over the network;

making the game available for sale via the third retail platform over the network;

automatically manufacturing a game board and the components of the board game at a fourth manufacturing platform with a manufacturing device in electronic communication with the third retail platform, the manufacturing based at least in part on the instructions transmitted by the third retail platform and generated from the user-specified game information and the set of rules or analytics;

automatically setting a minimum price of the game based on the at least one standardized component offered with the game design kit; and packaging and shipping the manufactured board game to a purchaser.

2. The method of claim 1, wherein manufacturing the components of the board game is performed with a print on demand device upon a sale of the game.

3. The method of claim 1, wherein the information is received from the user in response to a menu of options provided to the user.

4. The method of claim 3, receiving a purchase request from a purchaser via a second computing device over a communications link on a network.

5. The method of claim 1, wherein at least a portion of the information received from the user is selected from the group consisting of card information, token information and dice information.

6. A system for designing and selling a user-generated board game comprising:

a first game design platform having a game design engine in electronic communication with a game designer over a network for receiving user-specified game information, including game parameters, for a user-defined game;

a game design kit separate from the game design platform, the game design kit having at least one standardized component for designing a tabletop game;

a second game development platform having a media creation engine in electronic communication with the game design engine for automatically generating instructions for development of components of the board game based at least in part on the user-specified game information and a set of rules or analytics;

a third retail platform in electronic communication with the media creation engine for receiving instructions therefrom to sell the game directly to a purchaser over the network;

an automatic manufacturing device in electronic communication with the third retail platform, the automatic manufacturing based at least in part on the instructions transmitted by the third retail platform and generated from the user-specified game information and the set of rules or analytics;

and a fourth platform for packaging and shipping the manufactured board game;

wherein a minimum price of the game is automatically set based on the at least one standardized component offered with the game design kit.

7. The system of claim 6, wherein the manufacturing device is a print on demand device in electronic communication with the retail platform to manufacture components of the board game upon sale thereof.

8. The system of claim 6, wherein the game parameters include game rules and at least one of a type, number, shape, color, and price of a component to be utilized in the user-created board game.

9. The system of claim 8, wherein the type of component includes at least one of dice, tokens, and cards.

10. The system of claim 8, wherein the game design engine restricts at least some of the game parameters.

11. The system of claim 6, wherein the instructions generated by the media creation engine include a minimum overall price for the board game.

12. The system of claim 6, wherein proceeds from the sale of the user-designed game are divided between the game designer and the platform.

13. The system of claim 6, wherein the game designer is required to sign-up for membership for use of the system.

14. A method for designing and selling a user-generated game comprising:

electronically communicating by a first game design engine with a game designer via a game design platform over a network;

electronically communicating by the first game design engine a game design kit separate from the game design platform, the game design kit having at least one standardized component for designing a tabletop game;

electronically receiving from the game designer user-specified game information, including game parameters, for a user-defined game;

electronically transmitting user-specified game information to a second media creation engine;

automatically generating by the second media creation engine instructions for development of components of the game based at least in part on the user-specified game information and a set of rules or analytics;

electronically transmitting the instructions to a third retail engine;

selling the game directly to a purchaser over the network via the retail engine;

automatically manufacturing the components of the game with a manufacturing device in electronic communication with the third retail engine, the manufacturing based at least in part on the instructions transmitted by the third retail engine and generated from the user-specified game information and the set of rules or analytics;

automatically setting a minimum price of the game based on the at least one standardized component offered with the game design kit; and packaging and shipping the manufactured game to the purchaser.

15. The method of claim 14, wherein manufacturing the components of the game is upon sale thereof, by a print on demand device in electronic communication with the retail platform.

16. The method of claim 14, wherein the game parameters include game rules and at least one of a type, number, shape, color, and price of a component to be utilized in the user-created game.

17. The method of claim 16, wherein the type of component includes at least one of dice, tokens, and cards.

18. The method of claim 16, wherein the game design engine restricts at least some of the game parameters.

19. The method of claim 14, wherein the instructions generated by the media creation engine include a minimum overall price for the game.

20. The method of claim 14, further comprising requiring the game designer to sign-up for membership for use of the system.

* * * * *